United States Patent [19]

Kirk

[11] 3,966,200

[45] June 29, 1976

[54] STRETCHING EXERCISING DEVICE

[76] Inventor: Norman Kirk, 9 Rosedale Ave., Montclair, N.J. 07042

[22] Filed: May 12, 1975

[21] Appl. No.: 576,583

[52] U.S. Cl. ..... 272/109; 272/116; 272/144; 5/332

[51] Int. Cl.[2] ..... A63B 21/10

[58] Field of Search ..... 272/57 R, 58, 80, 57 D, 272/79 R; 5/319, 327 R, 332

[56] References Cited

UNITED STATES PATENTS

| | | | |
|---|---|---|---|
| 1,240,191 | 9/1917 | Fox | 272/80 |
| 1,950,174 | 3/1934 | Harrison | 272/80 |
| 2,300,898 | 11/1942 | Allen | 5/319 |
| 2,709,818 | 6/1955 | Freese | 5/332 |
| 2,895,736 | 7/1959 | Adler et al. | 272/58 |
| 3,134,592 | 5/1964 | Sharkey | 272/58 |
| 3,567,218 | 3/1971 | Johnson | 272/58 |

*Primary Examiner*—Jerome Schnall
*Attorney, Agent, or Firm*—Richard L. Miller

[57] ABSTRACT

An exercising apparatus for use by a person so to stretch himself physically for purpose of good health; the apparatus consisting of a low table having a rail along each longitudinal side thereof, and a pair of inverted U-shaped bars being slidably adjustable along the rails, the bars both bridging over the table so that a person laying on the table can hook his feet behind one of the bars and grasp the other bar with his hands so to stretch himself therebetween.

1 Claim, 5 Drawing Figures

Fig. 1
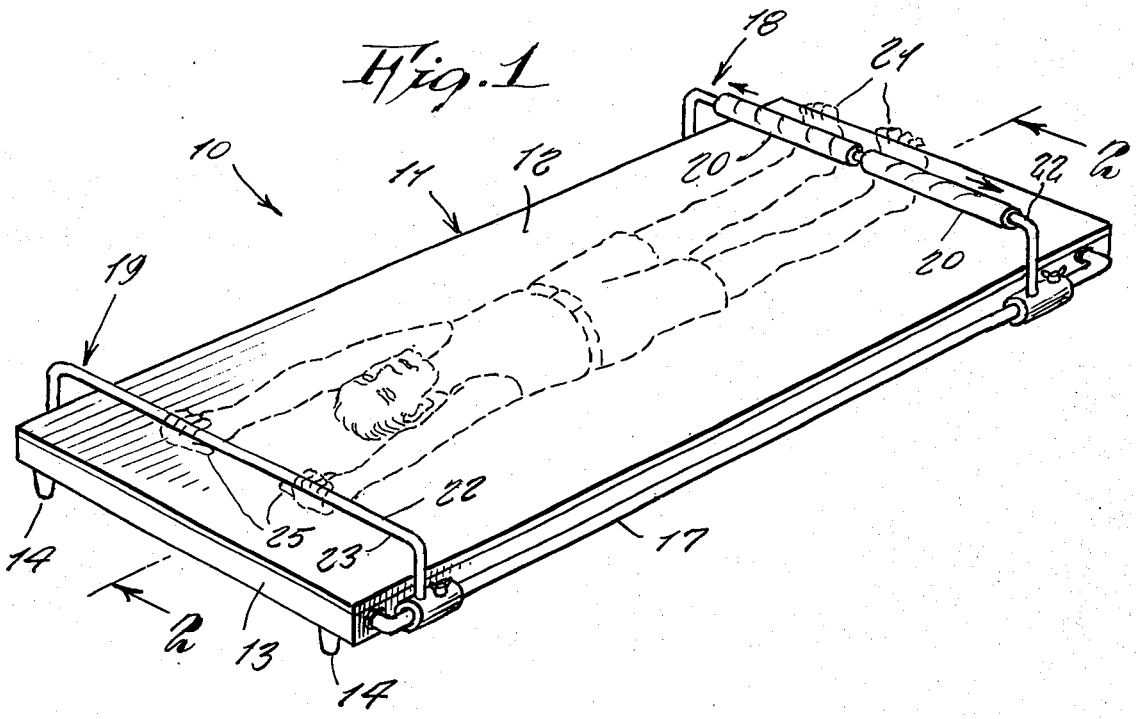
Fig. 2
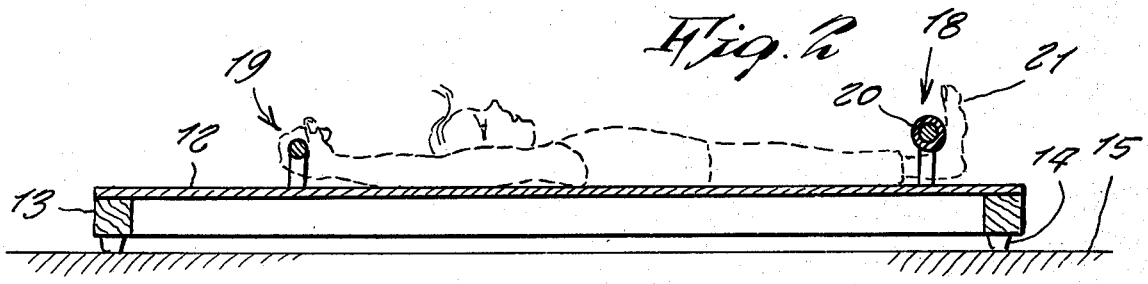
Fig. 3
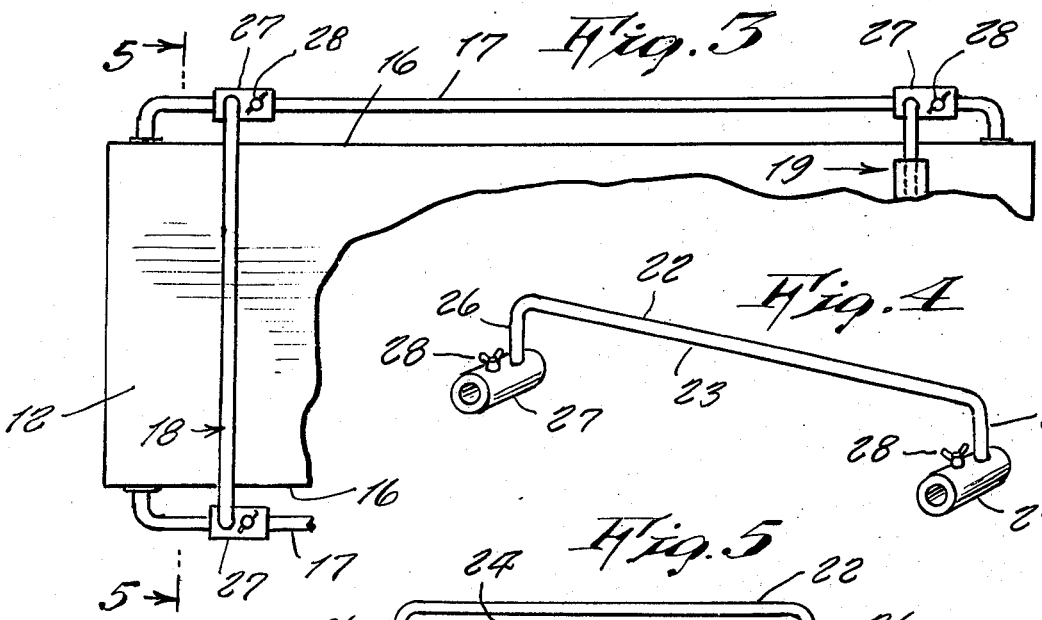
Fig. 4
Fig. 5
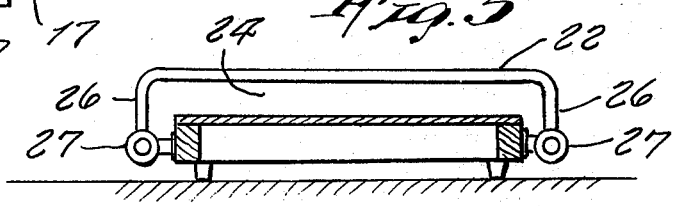

STRETCHING EXERCISING DEVICE

This invention relates generally to exercising apparatus.

A principal object of the present invention is to provide an exercising device upon which a person can stretch himself out so to feel better and improve his health.

Another object is to provide a stretching exercising device which causes the person's spine to be stretched between the vertebra so to give a more refreshed and relaxed feeling, which improves the person's posture, and which overcomes many of the maladies caused by poor posture or by compressed cartridge pads located between the vertebra of the spine.

Yet another object is to provide a stretching exercising device for use by adults or children, and which improves a person's height.

Other objects are to provide a stretching exercising device which is simple in design, inexpensive to manufacture, rugged in construction, easy to use and efficient in operation.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

FIG. 1 is a perspective view of the present invention shown in use by an adult.

FIG. 2 is a side cross sectional view taken on line 2—2 of FIG. 1 and showing the device adjusted for use by a child.

FIG. 3 is a fragmentary top view of the device.

FIG. 4 is a perspective view of one of the bars of the device.

FIG. 5 is a transverse cross sectional view taken on line 5—5 of FIG. 3.

Referring now to the drawing in detail, the reference numeral 10 represents a stretching exercising device according to the present invention wherein there is a flat table 11 consisting of horizontal, rectangular panel 12 mounted upon a strengthening frame 13 that is supported upon low, short legs 14 for standing upon a floor 15.

Along each longitudinal side edge 16 of the table, there is stationarily mounted a rail 17 made of strong pipe or the like, which extends the length of the side edge and is spaced parallel therefrom, except the ends of the rails being bent at right angle so to be rigidly affixed to the table frame.

A pair of bars 18 and 19 are supported at each their ends upon the rails, the bars bridging across the top of the table and being slidably adjustable along the rails.

Both bars are alike except that the bar 18 includes cushion rollers 20 so a person's feet 21 can be comfortably hooked thereagainst.

Each bar 18 and 19 includes a U-shaped pipe 22 having a straight central portion 23 that is parallel to and spaced above a top surface of the table so to form a space 24 therebetween in order that a person's feet or hands 25 may be fitted therein. Each end 26 of the pipe is downwardly bent at right angle and is welded or otherwise rigidly affixed to a metal sleeve 27 that is slidable along the rail. A winged set screw 28 on each sleeve can be manually turned so to selectively lock the sleeve along any desired point of a rail, so that the bars can thus be secured closure or farther apart in order to suit person's of different heights.

All the pipes, sleeves and metal parts are polished bright so to be smooth to a person's touch.

The cushion rollers 20 are made of a soft sponge rubber or the like, and the surface thereof may be made spiralled so to stimulate circulation in the feet if rolled thereagainst. Each roller is slidable along bar 22 for other exercises.

The table frame and panel are preferably of wood so to be lightweight while being also strong. A soft thin pad of rubber or other material may be placed upon the table for comfort when a person lays down thereupon.

In use, as shown, a person adjusts the bars to suit his own height. He then places his feet behind the bar 18 and grasps the bar 19 with his hands and pulls on both so to thus stretch himself. Various forms of the exercise may be done, such as laying on his back, side or abdomen, as wished for variety.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An exercising apparatus, comprising in combination, a low table, a rail along opposite two side edges of said table, and a pair of inverted, U-shaped bars bridging said table being slidably, adjustably supported at their ends upon said rails; said table comprising a rectangular flat panel mounted upon a frame supported upon short corner legs, each said rail comprising a U-shaped metal pipe secured at each end of said table frame, a central portion of said pipe extending parallel and spaced from said table side edge, each said U-shaped bar comprising a metal pipe having a straight central portion that is parallel and spaced above said table panel, opposite ends of said U-shaped bars being downwardly bent and affixed in metal sleeves slidable on said rails, and winged set screw means for locking said bars in a fixed position along said rails, and a pair of cushioned rollers of soft rubber being slidably fitted on one said bar for cushioning a person's feet bearing thereagainst, and a cylindrical surface of each said roller being spiralled for feet stimulation when rolled thereagainst.

* * * * *